United States Patent [19]

Runkel

[11] Patent Number: 4,771,959

[45] Date of Patent: Sep. 20, 1988

[54] YARN WINDING APPARATUS

[75] Inventor: Walter Runkel, Remscheid, Fed. Rep. of Germany

[73] Assignee: Barmag AG, Remscheid, Fed. Rep. of Germany

[21] Appl. No.: 56,967

[22] Filed: Jun. 3, 1987

[30] Foreign Application Priority Data

Jun. 6, 1986 [DE] Fed. Rep. of Germany ..... 3619186

[51] Int. Cl.[4] ..... B65H 54/02; B65H 54/52

[52] U.S. Cl. ..... 242/18 R; 242/43 R

[58] Field of Search ..... 242/18 R, 18 DD, 18 B, 242/18 G, 43 R, 18 CS

[56] References Cited

U.S. PATENT DOCUMENTS 2,965,322 12/1960 Wiering ..... 242/18 R

*Primary Examiner*—Stanley N. Gilreath

*Attorney, Agent, or Firm*—Bell, Seltzer, Park & Gibson

[57] ABSTRACT

A yarn winding apparatus is disclosed which comprises a spindle mounted for rotation about a fixed axis, and a slide which is mounted adjacent the spindle and which includes a traversing yarn guide and a contact roll for engaging the surface of the package being wound on the spindle. Also, the slide is movable in a radial direction with respect to the spindle, and so that the slide moves radially outwardly as the package builds. Further, biasing means is provided for biasing the slide toward the package during the winding operation. The biasing means comprises structurally simple components, and permits ready control of the biasing force during the entire winding operation.

8 Claims, 3 Drawing Sheets

1
2
3
10
13
14
14
15
21
28
50
51
52
53
54
54a
55
56
57
58
58
59

1
2
3
10
13
14
14
15
21
28
50
51
52
53
54
54a
55
56
57
58
58
59

YARN WINDING APPARATUS

BACKGROUND OF THE INVENTION

The present invention relates to a yarn winding apparatus of the type comprising a winding spindle which is rotated about a fixed axis and which is adapted to coaxially mount a bobbin tube for receiving the yarn, and so as to form a wound package thereon. Also, the apparatus includes a yarn traversing mechanism which is mounted in a slide which is adapted to move radially away from the spindle as the package builds on the bobbin tube.

Winding apparatus of the described type are known wherein the bobbin tube which is mounted on the spindle is rotatably driven by contact with a drive roll, note for example DE-OS No. 25 44 773 and U.S. Pat. No. 4,106,710. In order to apply the necessary driving force to the surface of the package as the diameter increases, there is provided means for regulating the pressure of the contact roll against the surface of the package, and which includes a pneumatic control by which a nominal value can be determined. In most instances, the slide is vertically movable, but according to one of the embodiments of the above described patents, the traversing slide is horizontally movable and incudes similar contact pressure regulating means. In the case of a yarn winding apparatus having a surface driven winding spindle, the contact pressure between the contact roll and the package needs to be accurately controlled, so as to prevent the sensitive layers of yarn on the surface of the package from being damaged by too much slippage. However, in the case of directly driven winding spindles, it is not usually necessary to control the contact pressure for these functional reasons.

Precision package winding apparatus are also known, in which the slide mounting the traversing mechanism is moved radially from the axis of the winding spindle, or along a circular arc about a fulcrum. The slide typically mounts a contact roll which is pressed against the surface of the package by for example a compensating weight, note U.S. Pat. No. 3,480,218, or by a resilient biasing means, note DE-OS No. 2,937,600, or by a cylinder-piston drive, note U.S. Pat. No. 3,717,311. The contact pressure serves to dampen the fluctuations which result from the movement of the slide. In addition, it has been found that the package build is advantageously influenced, when the pressure between the contact roll of the slide and the package surface is distributed over the entire axial length of the package.

It is accordingly an object of the present invention to provide a yarn winding apparatus of the described type and wherein the contact pressure between the contact roll supported in the slide and the surface of the package may be controlled by a relatively simple mechanical mechanism.

It is also an object of the present invention to provide a yarn winding apparatus of the described type wherein the contact pressure can be selected and controlled in accordance with the winding conditions, and preferably in a manner so that the pressure decreases during the build of the package.

SUMMARY OF THE INVENTION

These and other objects and advantages of the present invention are achieved in the embodiments illustrated herein by the provision of a yarn winding apparatus which comprises a frame, a winding spindle mounted to the frame for rotation about a fixed axis, and a slide mounted to the frame adjacent the spindle and so as to permit radial movement with respect to the spindle axis. The slide mounts yarn traversing means which is adapted to traverse a yarn onto a bobbin tube mounted on the spindle to form a wound package, and the slide also mounts a contact roll which is disposed parallel to the winding spindle and which is adapted to contact the wound package and move the slide away from the spindle as the package builds. The apparatus further comprises drive means for rotating the spindle and traversing the yarn traversing means, and means for biasing the slide toward the spindle during the build of the package.

In accordance with the present invention, the biasing means comprises an arm having one end pivotally connected to the slide at a pivot point, and an opposite free end. Also, a cam is mounted to the frame and includes a guide edge disposed transversely to the direction of movement of the slide and so as to engage the opposite free end of the arm during movement of the slide. Means is also provided for applying a force to the arm which tends to rotate the arm about the pivot point and into engagement with the cam, and such that a component of the force tends to move the slide toward the spindle during the build of the package. The magnitude of the component of force may be controlled by adjusting the magnitude of the force applying means, and/or selecting the orientation and outline of the guide edge. In the preferred embodiment, the force applying means comprises a spring extending between an attachment point on the slide and another attachment point on the arm. Also, the attachment point on at least one of the slide and the arm is adjustable to control the magnitude of the applied force.

The present invention thus provides a constructionally simple arrangement for biasing the slide into contact with the package, and which is not susceptible to breakdown, and which is adjustable in numerous ways so as to vary the contact pressure between the contact roll on the slide and the package being formed. This adjustment may be achieved by means of the guide edge, the angle of inclination of which may be adjusted with respect to the direction of movement of the traversing slide, or by exchanging the cam for a cam having a differently curved guide edge, so that a guide edge which is optimally adapted to the particular winding operation may be selected.

The ability to adjust the magnitude of the force applied by the biasing means has the advantage that the contact pressure between the contact roll and the package can be varied while using the same structural members, since the same structural members can be selectively positioned to exert different levels of force on the slide, with the force thereby being adapted to the particular winding conditions and desired results.

BRIEF DESCRIPTION OF THE DRAWINGS

Some of the objects and advantages of the present invention having been stated, others will appear as to description proceeds, when taken in conjunction with the accompanying drawings, in which.

DETAILED DESCRIPTION OF THE PREFERRED EMBODIMENT

Figure 1:
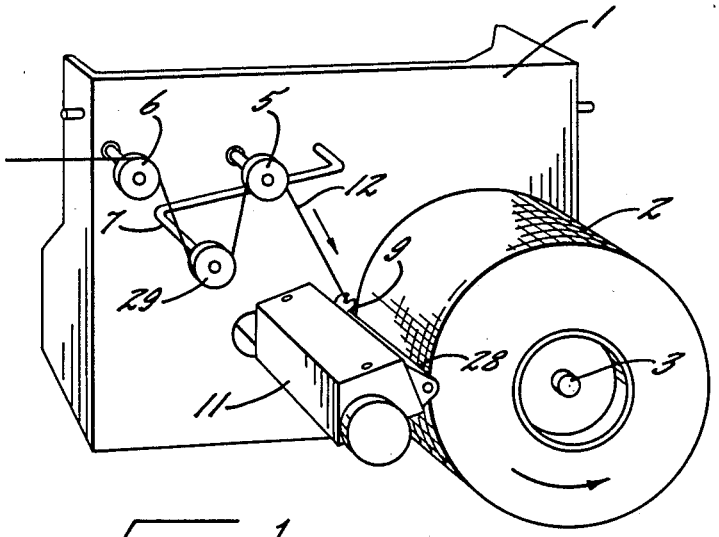
FIG. 1 is a perspective view of a yarn winding apparatus which embodies the features of the present invention.

Referring more particularly to the drawings, FIG. 1 illustrates a yarn winding apparatus in accordance with the present invention, and which includes a vertical housing plate 1 which comprises a portion of the frame of the apparatus, together with a winding spindle 3 which coaxially mounts a bobbin tube having a package 2 wound thereon. The spindle 3 is rotatably driven by a motor 4, and the yarn 12 advances at a substantially uniform speed over the stationary yarn guides 5 and 6, as well as over a compensating roll 29 which is rotatably supported on the arm 7. The yarn 12 is thus wound onto the package on the spindle 3 under a substantially uniform tension.

Figure 2:
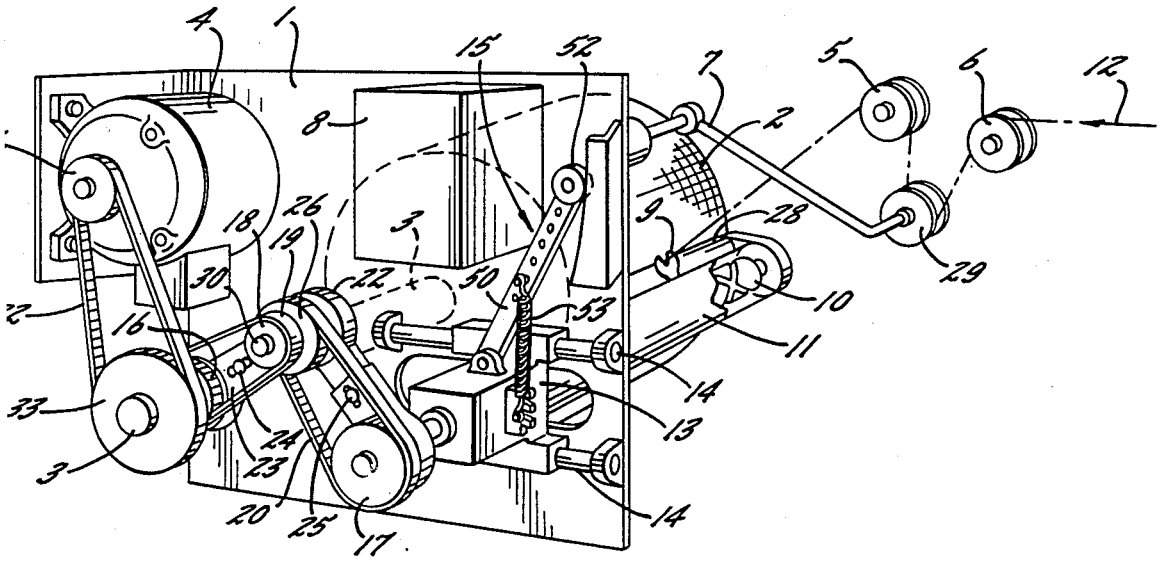
FIG. 2 is a perspective view of the apparatus shown in FIG. 1, and viewed from the drive side.

The apparatus further comprises a slide 11 which is mounted to the plate 1 of the frame adjacent the spindle and so as to permit radial movement with respect to the axis of the spindle and along a generally horizontal direction. More particularly, the slide 11 includes a support 13, which is slideable along the guide rods 14 which extend in a horizontal direction as best seen in FIG. 2. The slide 11 mounts a yarn traversing guide 9 which serves to reciprocate the yarn 12 in the axial direction of the package 2, and the guide 9 is guided in a straight slot in the slide 11, and is driven by a cross spiraled roll 10 which is also mounted in the slide 11, note FIG. 2. The slide 11 further includes a contact roll 28 which is disposed parallel to the axis of the winding spindle and so as to contact the surface of the package 2 and thereby support the slide at a predetermined distance with respect to the package. As a result, the distance between the traversing guide 9 and the package remains constant, since the support 13 which carries the slide 11 is moved away from the circumference of the package in a straight line along the fixed guide rods 14.

FIG. 2 also illustrates the drive means for rotating the spindle 3 and for traversing the yarn guide 9. As will become apparent, the illustrated drive means is of the precision winding type, in that the drive means provides an operative, fixed connection between the winding spindle and the cross spiraled roll 10 of the yarn traversing means. More particularly, the drive means includes the motor 4, which preferably comprises a speed controllable asynchronous motor, which is directly connected to the winding spindle 3 via a toothed belt 32 and pulleys 31 and 33. From the winding spindle 3, the drive is transmitted to the cross spiraled roll 10, via an intermediate transmission which not only rotatably interconnects the roll 10 to the motor 4 during the entire winding operation, but in addition permits the support 13 and the slide 11 to move along the guide rods 14 away from the package as the diameter of the package increases. This intermediate transmission includes the toothed belts 19 and 20, which are mounted respectively on the belt pulley 16 on the spindle 3 and the pulley 17 which is fixed on the shaft of the roll 10. The shaft 30 for the intermediate joined pulleys 18 and 26 is attached to a pivoting lever 23, which in turn is rotatably supported on the spindle 3 and is longitudinally adjustable by a sliding connection 24. In addition, the shaft 30 is supported on a supporting lever 22, which is also longitudinally adjustable by a slide connection 25 and is rotatable on the shaft of the roll 10.

A transformer 8 is provided for controlling the speed of the motor 4 for the winding spindle 3. A control signal which is a function of the yarn tension as measured by the deflection of the arm 7, is delivered to the transformer and so as to control the speed of the motor 4 in a conventional manner. FIG. 2 also illustrates the means for biasing the slide 11 toward the spindle during the build of the package, and which is indicated generally at 15.

Figure 3:
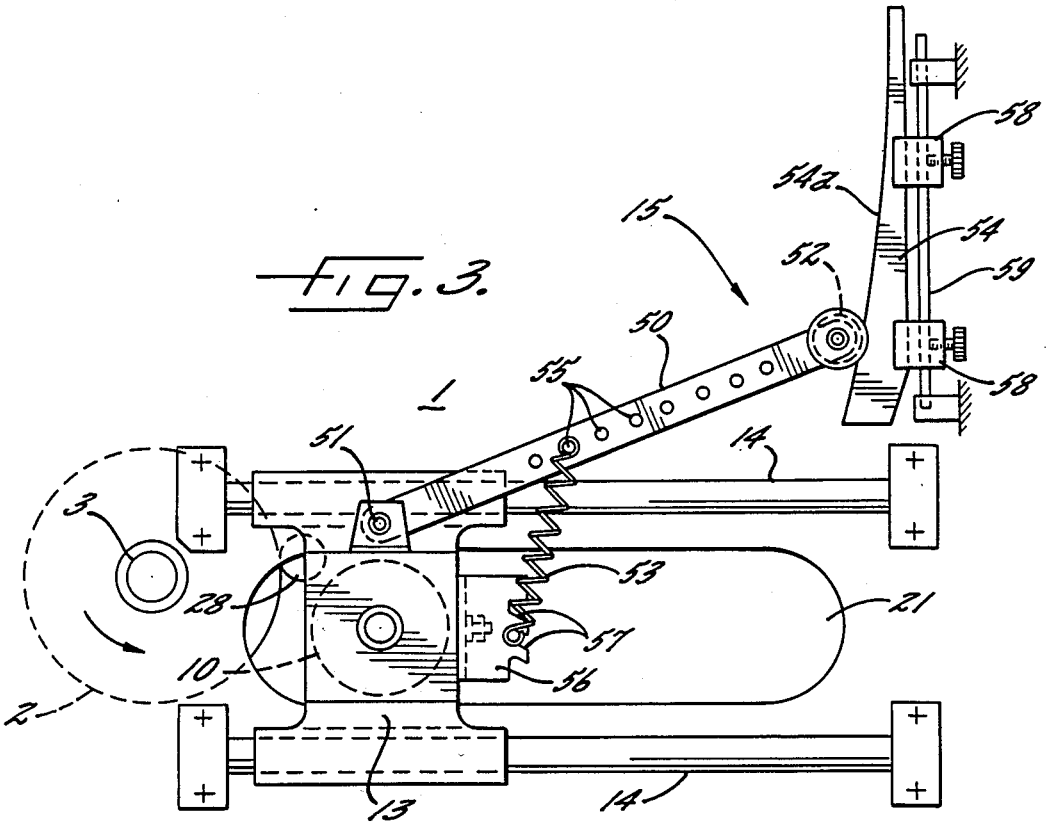
FIG. 3 is a fragmentary side elevation view of the slide of the present invention, together with the means for biasing the slide toward the package, and shown at the start of a winding operation.
Figure 4:
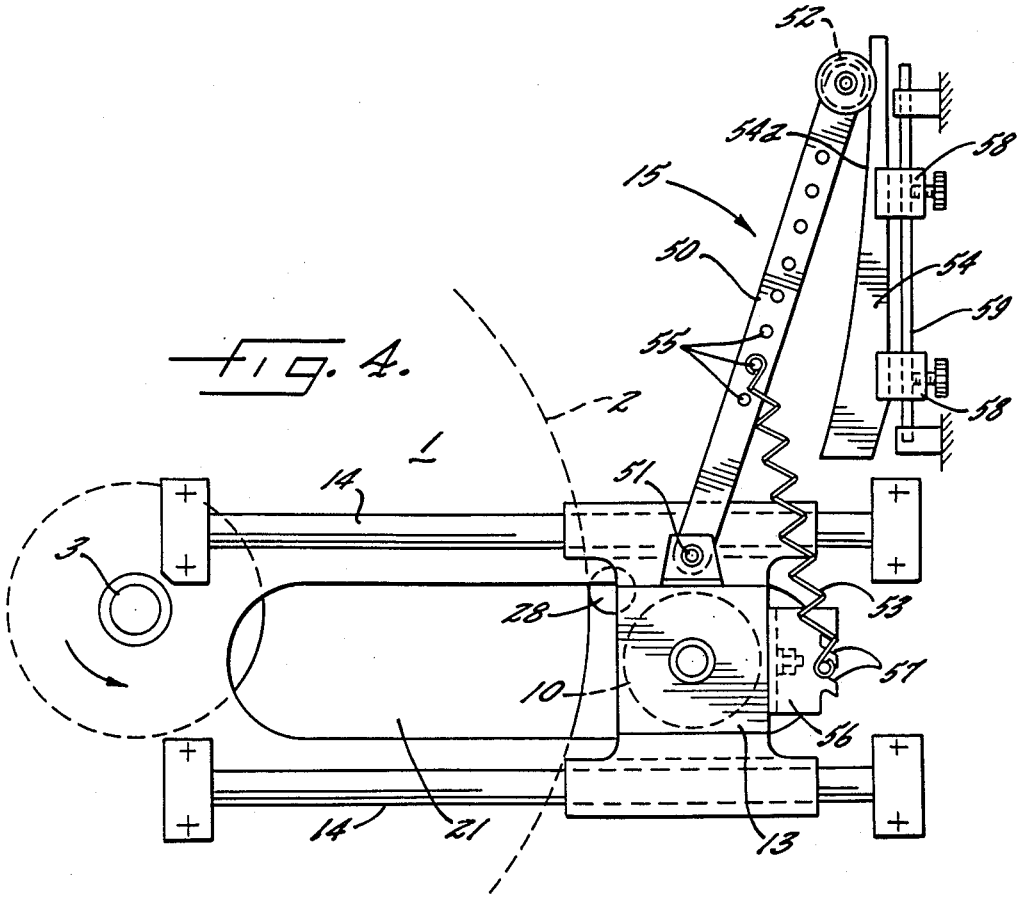
FIG. 4 is a view similar to FIG. 3, but illustrating the slide at the end of a winding operation.

FIGS. 3 and 4 illustrate in more detail the means 15 for biasing the slide toward the spindle. In these views, the drive members between the motor and spindle 3 and the roll 10 are omitted for clarity of illustration.

FIG. 3 illustrates one end position of the reciprocating slide 11, and wherein the package formed on the spindle 3 has its smallest diameter. FIG. 4 on the other hand shows the position of the slide 11 when the diameter of the package has reached its maximum.

The biasing means 15 comprises an arm 50, which has one end pivotally connected to the slide at a pivot point 51, with the pivotal axis extending transversely, and preferably perpendicular to the direction of movement of the slide. The arm 50 includes an opposite free end which rotatably supports a roller 52. Also, there is provided a cam 54 which is mounted to the frame of the apparatus and which includes a guide edge 54*a* disposed transversely to the direction of movement of the slide and so as to engage the roller 52 at the free end of the arm 50. A force applying means is also provided which applies a force to the arm 50 which tends to rotate the arm about the pivot point 51 and so that the roller 52 is pressed into engagement with the guide edge 54*a* of the cam 54. Thus a component of the force tends to move the slide toward the spindle during the build of the package, and the magnitude of this component of force is controlled by the magnitude of the force applying member and the orientation and outline of the guide edge 54*a* of the cam.

In the illustrated embodiment, the force applying member comprises a spring 53 which extends between an attachment point 55 on the arm and an opposite attachment point positioned on a mounting plate 56, which in turn is mounted to the support 13 of the slide 11. The plate 56 is provided with several teeth or notches 57, so as to permit adjustment of the attachment point of the spring 53 to the slide. Similarly, a number of attachment pins 55 are mounted along the length of the arm 50, which are equally spaced apart from each other, and such that the end of the spring may be attached to a selected one of the pins 55 to thereby vary the magnitude of its force.

The cam 54 is adjustably mounted to the frame of the apparatus, by means of a rod 59 which is fixed to the frame, and a pair of clamping devices 58 which are secured to the cam 54. Thus, the elevation of the cam may be varied. The configuration of the guide edge 54*a* of the cam 54 is, in the most simple case, a straight line. However, the guide edge may also be curved as illustrated, with the curve being empirically determined from the winding parameters. Also, the guide edge may be completely changed, by exchanging the cam 54 for another cam having the desired configuration.

FIG. 4 illustrates the slide 13 at the end of the winding cycle, and wherein the slide has moved along the guide rods 14 to its extreme end position. In this position, the roller 52 has moved upwardly along the guide edge 54*a* of the cam 54 to its highest position. While the spring 53 is, in this end position, substantially more lengthened and tensioned than in FIG. 3, the force component acting against the slide 11 may be actually less than in the position of FIG. 3, by reason of the changed angular position of the arm 50. Thus the force component acting against the package may be selectively controlled by the curvature of the guide edge 54*a*. As a result of the curvature of the guide edge, the contact pressure against the package may even decrease to a zero value during the winding operation.

Figure 5:
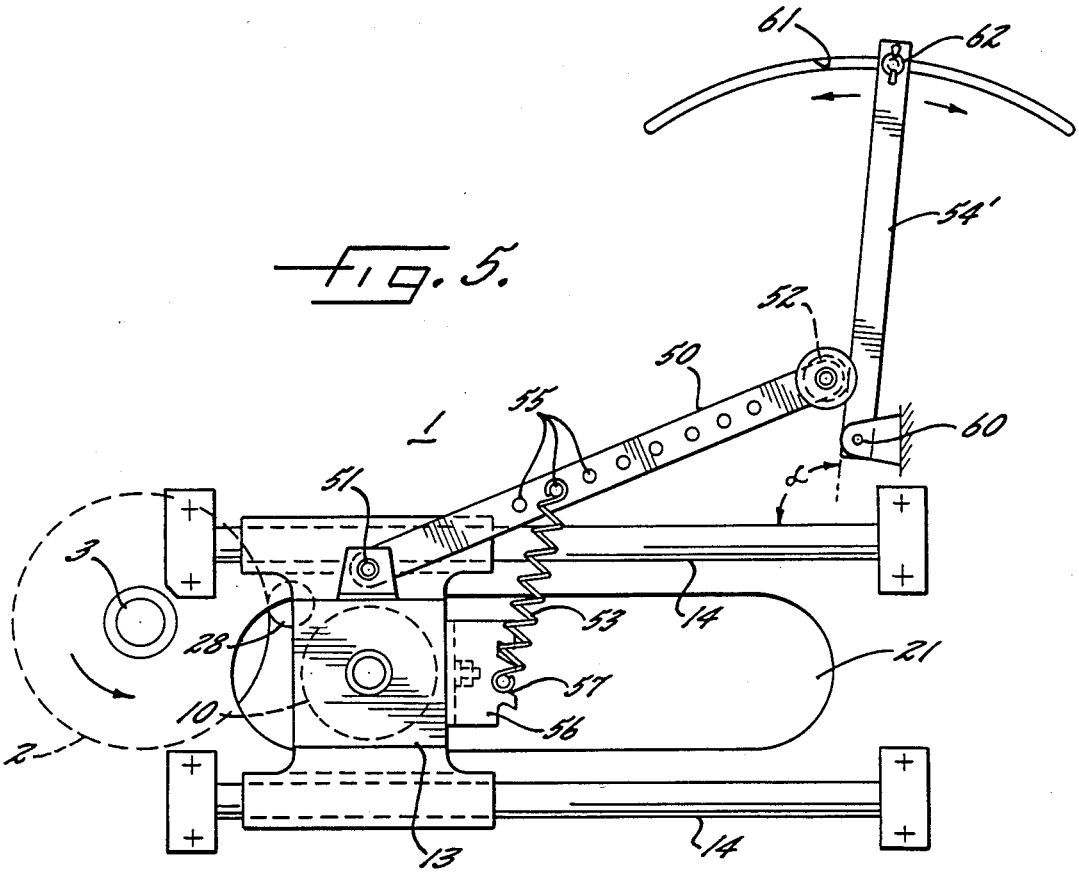
FIG. 5 is a view similar to FIG. 3, but illustrating a further embodiment of the slide biasing means.

FIG. 5 illustrates a different embodiment of the invention, with the slide 11 being illustrated at the start of the winding cycle. In this embodiment, the cam 54' is pivotally mounted to the frame at 60, and the opposite free end of the cam 54' includes a clamping device 62 which is movable along the arcuate slot 61, with the slot 61 representing a segment of a circle having its center at 60. The clamping device 62 is designed to secure the free end of the cam 54' in a selected pivotal position. In so adjusting the angular position of the cam 54', the angle alpha between the cam 54' and the straight guide rods 14 may be selected so that the component of the force which is operative on the slide is adjustable in magnitude and direction, and between limits which can be selected.

In the drawings and specification, there have been set forth preferred embodiments of the invention, and although specific terms are employed, they are used in a generic and descriptive sense only, and not for purposes of limitation.

That which is claimed is:

1. A yarn winding apparatus comprising a frame, a spindle mounted to said frame for rotation about a fixed axis, and with said spindle being adapted to coaxially mount a bobbin tube thereon, a slide mounted to said frame adjacent said spindle and so as to permit radial movement with respect to said axis of said spindle, said slide mounting yarn traversing means adapted to traverse a yarn onto a bobbin tube mounted on said spindle and form a wound package thereon, and a contact roll disposed parallel to said winding spindle for contacting the wound package and so as to move the slide away from the spindle as the package builds, drive means for rotating said spindle and driving said yarn traversing means, and means for biasing said slide toward said spindle during the build of the package, said biasing means comprising an arm having one end pivotally connected to one of said slide and said frame at a pivot point and an opposite free end, a cam mounted to the other of said slide and said frame and including a guide edge disposed transversely to the direction of movement of said slide and so as to engage said opposite free end of said arm during movement of said slide, and means applying a force to said arm tending to rotate said arm about said pivot point and into engagement with said guide edge of said cam and such that a component of said force tends to move said slide toward said spindle during the build of the package, and further comprising means for adjustably mounting said cam to said other of said slide and said frame so as to permit adjustment of said component of force.

2. The yarn winding apparatus as defined in claim 1 wherein said one end of said arm is pivotally connected to said slide, and said cam is adjustably mounted to said frame.

3. The yarn winding apparatus as defined in claim 2 wherein said force applying means comprises a spring extending between an attachment point on said slide and another attachment point on said arm, with at least one of said slide and said arm having a plurality of such attachment points, so that the attachment point to which said spring is attached may be changed.

4. The yarn winding apparatus as defined in claim 1 wherein said means for adjustably mounting said cam includes a pivotal connection between said cam and said frame.

5. The yarn winding apparatus as defined in claim 2 further comprising means for removably mounting said cam to said frame so as to permit selective use of cams having different guide edge configurations.

6. The yarn winding apparatus as defined in claim 1 wherein said free end of said arm mounts a roller which is positioned to engage and roll along said guide edge of said cam.

7. The yarn winding apparatus as defined in claim 1 wherein said drive means is operatively connected to both said spindle and said yarn traversing means, so as to drive the same at fixed relative speeds.

8. The yarn winding apparatus as defined in claim 1 wherein the orientation and outline of said guide edge are configured such that said component of force remains constant or decreases as the wound package builds.

* * * * *